US006481321B2

(12) United States Patent
Takemura et al.

(10) Patent No.: US 6,481,321 B2
(45) Date of Patent: Nov. 19, 2002

(54) CUTTING APPARATUS UTILIZING HIGH-SPEED VIBRATION

(75) Inventors: Sokichi Takemura, Shizuoka (JP); Katsuhito Iwata, Shizuoka (JP)

(73) Assignee: Tenryu Seikyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/903,490

(22) Filed: Jul. 12, 2001

(65) Prior Publication Data

US 2002/0005102 A1 Jan. 17, 2002

(30) Foreign Application Priority Data

Jul. 13, 2000 (JP) ..... 2000-212965

(51) Int. Cl.[7] ..... B26D 7/06
(52) U.S. Cl. ..... 83/435; 83/676; 83/469
(58) Field of Search ..... 83/676, 331–349, 83/663–678, 469–508.3, 435

(56) References Cited

U.S. PATENT DOCUMENTS 3,733,094 A * 5/1973 Emter ..... 287/53 R
5,027,684 A * 7/1991 Neukam ..... 83/481

FOREIGN PATENT DOCUMENTS

JP 10-315206 12/1998

* cited by examiner

*Primary Examiner*—Derris H. Banks
*Assistant Examiner*—Jamila Williams
(74) *Attorney, Agent, or Firm*—Arent Fox Kintner Plotkin & Kahn, PLLC

(57) ABSTRACT

A cutting apparatus includes a first annular member having a center eccentric from an axis of a rotating shaft and fixed to the rotating shaft. The cutting apparatus further includes a bearing with its inner race fixed to the first annular member, a disk cutter fixed relative to an outer race of the bearing, and a balancer fixed to the rotating shaft in a state being eccentric in the direction opposite to the eccentric direction of the first annular member.

10 Claims, 12 Drawing Sheets

CUTTING APPARATUS UTILIZING HIGH-SPEED VIBRATION

BACKGROUND OF THE INVENTION

1. Field of the Invention

The present invention relates to a cutting apparatus for cutting workpieces such as plates made from woods, resins, rubbers, or various fibers into specific widths.

2. Description of the Related Art

In the wood working industry including manufacture of residences, buildings, interiors, furniture, and the like, much of plates such as plywoods are used. Plates such as plywoods used for these applications are cut into predetermined dimensions, to be machined into shapes optimum to the applications. Saws such as circular saws or band saws are used to cut plates into specific dimensions. Apparatuses for cutting plates into specific dimensions with a saw are commercially available. A typical one of these apparatuses includes a supply mechanism for supplying a plate to a saw while holding both surfaces of the plate between rollers, a cutting mechanism disposed in a pathway of the plate supplied by the supply mechanism and having a circular saw for cutting the plate into specific widths, and a discharge mechanism for discharging the plate which has been already cut by the cutting mechanism.

The cutting apparatus having the above-described structure, however, has a disadvantage that since a large amount of chips, caused at the time of cutting a plate with a saw, are discarded by incineration or the like, an additional cost for discarding the chips must be taken into account. Another disadvantage is that since a saw blade has sets projecting from the saw teeth alternately in the opposite directions, the overall thickness of the saw includes the thickness of the sets in addition to the thickness of the saw blade, and accordingly, at the time of cutting a plate, a plate portion having a thickness of 3 to 5 mm is lost as cut chips, with a result that the plate cannot be cut in a state being overall effectively utilized. From the above description, it is apparent that the utilization efficiency of a plate becomes lower as the cutting width of the plate becomes finer. Now, it is assumed that when a plate is cut into a width of 50 mm with a saw, a plate portion having a width of 5 mm is lost. This means that about 10% of the plate cannot be effectively utilized due to the loss caused by cutting.

The apparatus for cutting plates with a saw has a further disadvantage that a noise level becomes significantly large, and more specifically, reaches 85 dB in the vicinity of the apparatus. The cutting apparatus of such a large noise level has a great difficulty in damping the noise, and therefore, has a large limitation in an installation environment of a factory containing the apparatus. The sawing apparatus has still a further disadvantage that it is difficult to obtain a smooth cut surface of a plate. This is because cutting marks caused by cutting with a large number of saw teeth remain on the cut surface of the plate. Accordingly, if pieces cut from a plate are used for an application requiring plate products each having a smoothly finished cut surface, the cut surface of each of the pieces must be smoothly cut by a plane or the like, or polished by a sheet of sand paper or the like, thereby giving rise to a problem that it takes a lot of time to finish the pieces cut from the plate.

A cutting apparatus improved to solve the above-described disadvantages of the apparatus of cutting plates with a saw has been proposed in Japanese Patent No. 2873224. The cutting apparatus for cutting plates, disclosed in this document, is configured to forcibly transfer a plate by a plate supply mechanism and a plate discharge mechanism, and cut the plate by making the plate pass through a plate cutting mechanism having a pair of upper and lower fixed cutter blades. The above cutting apparatus for cutting plates with the pair of upper and lower cutter blades can solve many of the disadvantages of the above-described apparatus for cutting plates with a saw. The cutting apparatus for cutting plates disclosed in the above patent, however, has a problem that since a plate is cut by forcibly pushing the plate to the fixed cutter blades of the cutting mechanism with the aid of a plate supply force given by the supply mechanism, a cutting ability is limited, and more specifically, a relatively thick plate cannot be cut.

SUMMARY OF THE INVENTION

An object of the present invention is to provide a cutting apparatus capable of efficiently cutting a workpiece such as a plate at a low noise level while reducing the occurrence of cut chips.

In accordance with an aspect of the present invention, there is provided a cutting apparatus including a first annular member having a center eccentric from an axis of a rotating shaft and fixed to the rotating shaft, a bearing having an inner race and an outer race, the inner race being fixed to the first annular member, a disk cutter fixed relative to the outer race of the bearing and a balancer fixed to the rotating shaft in a state being eccentric in the direction opposite to the eccentric direction of the first annular member.

Preferably, a second annular member is fixed to the outer race of the bearing, and the disk cutter is fixed to the second annular member. Preferably, at least a pair of cutter guides are disposed on both sides of the disk cutter. The cutting apparatus may further include a workpiece carrying mechanism for carrying a workpiece and a one-way rotating mechanism selectively engageable with either the disk cutter or the second annular member.

The rotating shaft may be rotated in the direction opposite to the carrying direction of the workpiece. The one-way rotating mechanism may be configured to prohibit the rotation of the disk cutter at the time of idling. With this configuration, the disk cutter is prevented from being rotated at a high speed together with the rotating shaft at the time of idling, to thereby ensure safety of an operator. At the time of cutting a workpiece, a workpiece carrying force is applied to the disk cutter to slowly rotate the disk cutter in the same direction as the workpiece carrying direction. Preferably, a distance between the center of the first annular member and the axis of the rotating shaft is in a range of 0.3 mm to 2.0 mm.

In accordance with another aspect of the present invention, there is provided an annular member having a center eccentric from an axis of a rotating shaft and fixed to the rotating shaft, a bearing fixed to the annular member and a disk cutter fixed relative to the bearing wherein the annular member is balanced in weight such that a center of gravity of a rotator including the annular member, the bearing, and the disk cutter coincides with the axis of the rotating shaft.

In accordance with a further aspect of the present invention, there is provided a workpiece carrying mechanism for carrying a workpiece, a first cutter assembly for partially cutting a workpiece carried by the workpiece carrying mechanism, the first cutter assembly being disposed on the upper side of the workpiece and a second cutter assembly for partially cutting a workpiece carried by the workpiece carrying mechanism, the second cutter assembly being disposed on the lower side of the workpiece wherein each of the first and second cutter assemblies includes a first annular member having a center eccentric from an axis of a rotating shaft and fixed to the rotating shaft, a bearing having an inner race and an outer race, the inner race being fixed to the first annular member, a disk cutter fixed relative to the outer race of the bearing and a balancer fixed to the rotating shaft in a state being eccentric in the direction opposite to the eccentric direction of the first annular member.

Preferably, the cutting apparatus further includes a synchronizing mechanism for rotating the rotating shaft of the first cutter assembly and the rotating shaft of the second cutter assembly in synchronization with each other. The eccentric direction of the center of the first annular member of the first cutter assembly from the axis of the rotating shaft may be opposite to the eccentric direction of the center of the first annular member of the second cutter assembly from the axis of the rotating shaft. With this configuration, the disk cutter of the first cutter assembly and the disk cutter of the second cutter assembly are idled with phases thereof being offset from each other by 180 degrees, with a result that it is possible to reduce vibration and noise.

Alternatively, the eccentric direction of the center of the first annular member of the first cutter assembly from the axis of the rotating shaft may be the same as the eccentric direction of the center of the first annular member of the second cutter assembly from the axis of the rotating shaft. With this configuration, the disk cutter of the first cutter assembly and the disk cutter of the second cutter assembly are idled with phases thereof being identical to each other, with a result that it is possible to reduce noise.

The above and other objects, features and advantages of the present invention and the manner of realizing them will becomes more apparent, and the invention itself will best be understood from a study of the following description and appended claims with reference to the attached drawings showing some preferred embodiments of the invention.

DESCRIPTION OF THE PREFERRED EMBODIMENTS

Figure 1:
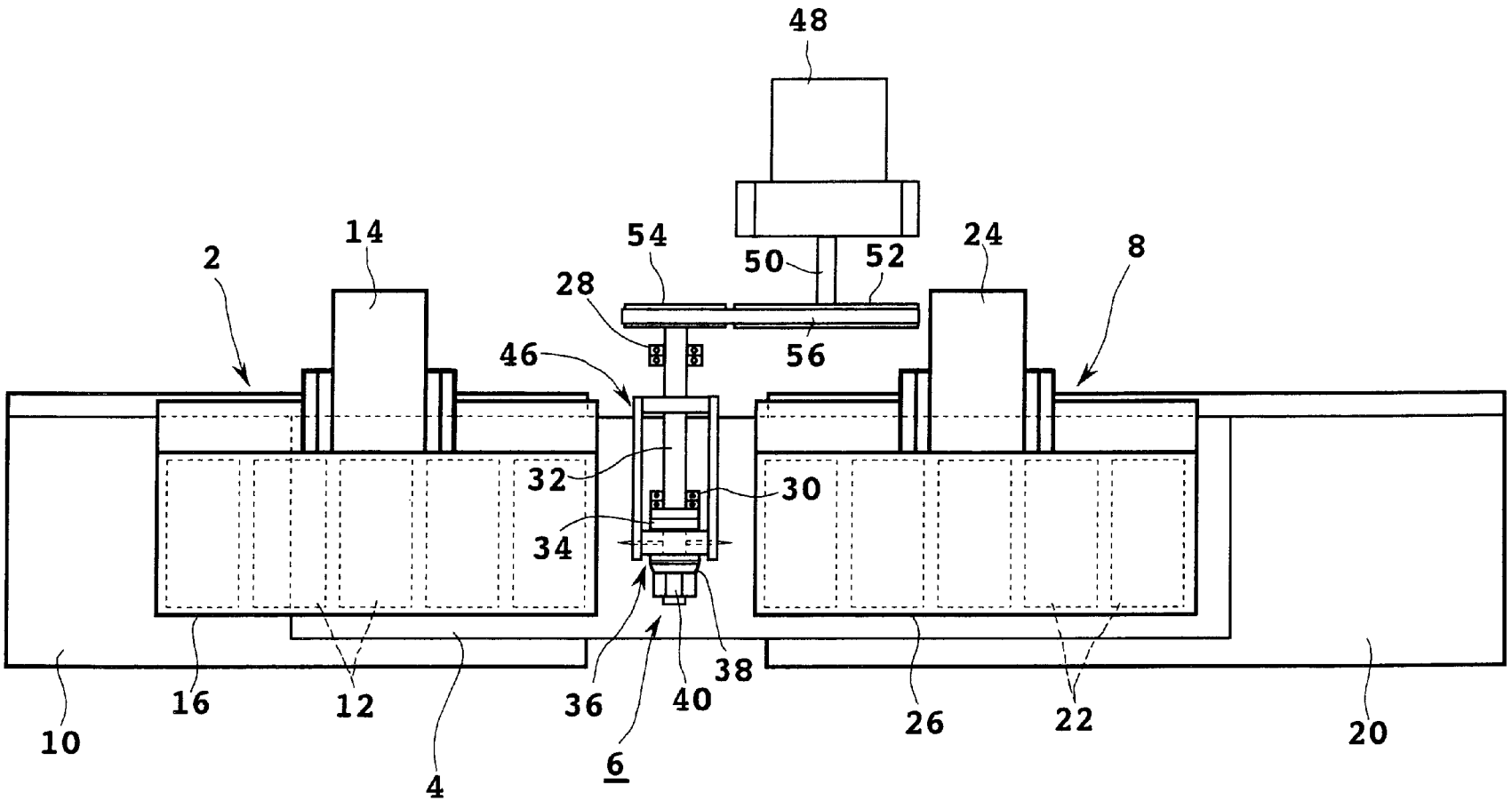
FIG. 1 is a plan view of a cutting apparatus according to a first embodiment of the present invention.
Figure 2:
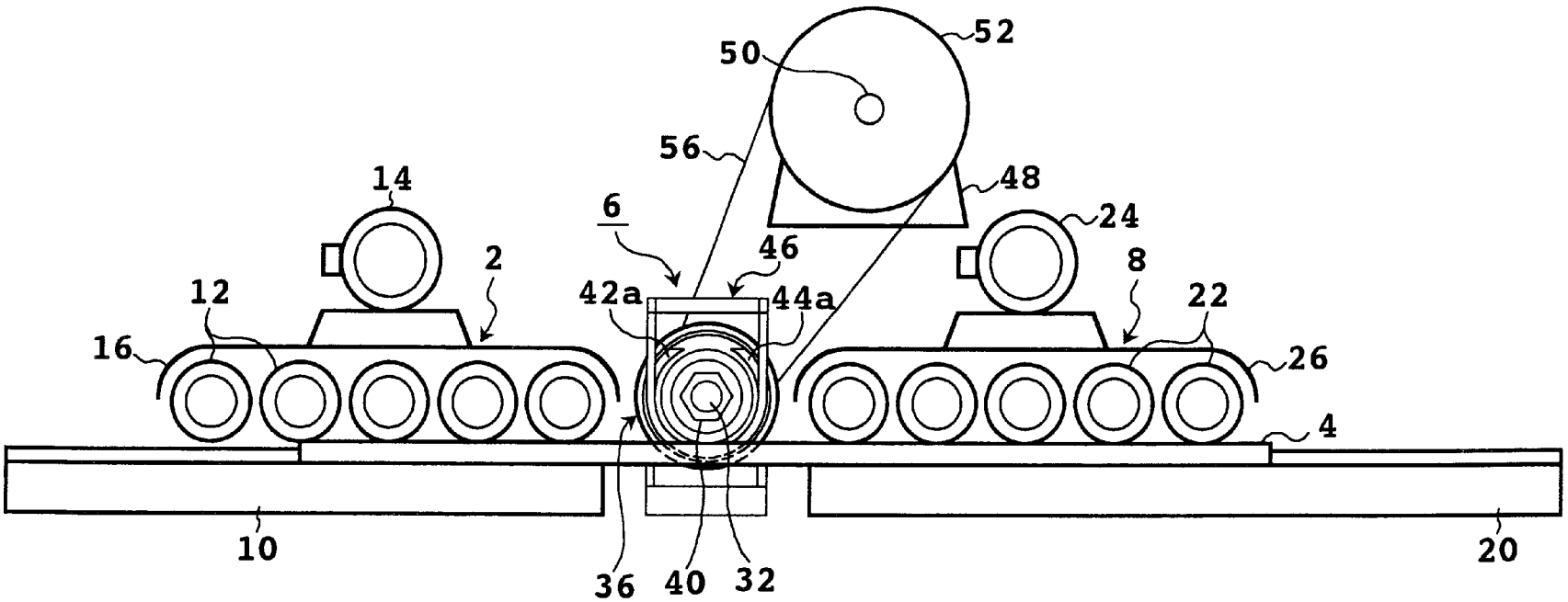
FIG. 2 is a front view of the cutting apparatus according to the first embodiment.

Hereinafter, some preferred embodiments of the present invention will be described with reference to the drawings. In the description of these embodiments, parts being substantially the same are designated by the same reference numerals. Referring to FIG. 1, there is shown a plan view of a cutting apparatus according to a first embodiment of the present invention. FIG. 2 is a plan view of the cutting apparatus shown in FIG. 1.

The cutting apparatus according to this embodiment includes a supply mechanism 2 for supplying a workpiece 4 such as a plywood, a cutting mechanism 6 for cutting the workpiece 4 supplied by the supply mechanism 2, and a discharge mechanism 8 for discharging the workpiece cut by the cutting mechanism 6. The supply mechanism 2 and the discharge mechanism 8 constitute a workpiece carrying mechanism. The supply mechanism 2 includes a workpiece guide 10 for guiding the workpiece 4. The supply mechanism 2 further includes a plurality of drive rollers (feed rollers) 12 for supplying the workpiece 4 to the cutting mechanism 6 in cooperation with the workpiece guide 10.

The drive rollers 12 are rotatably mounted on a frame 16 via bearings (not shown). In this case, the lowermost portions of the drive rollers 12 are aligned on the same horizontal plane. Each drive roller 12 is connected to a motor 14 via a belt, a chain, a gear, or the like and is rotated, by the motor 14, in the direction of supplying the workpiece 4 to the cutting mechanism 6. The discharge mechanism 8 is similar to the supply mechanism 2. The discharge mechanism 8 includes a workpiece guide 29 for guiding the workpiece 4. The discharge mechanism 8 further includes a plurality of drive rollers (feed rollers) 22 for discharging the workpiece 4, which has been already cut, in cooperation with the workpiece guide 20.

The drive rollers 22 are mounted to a frame 26 via bearings (not shown). In this case, the lowermost portions of the drive rollers 22 are aligned on the same horizontal plane. Each drive roller 22 is connected to a motor 24 via a belt, a chain, a gear, or the like and is rotated in the direction of discharging the workpiece 4 from the cutting mechanism 6. The cutting mechanism 6 includes a rotating shaft 32 rotatably supported by a pair of bearings 28 and 30. A flange 34 is fixed to the rotating shaft 32. A cutter assembly 36 is then mounted to the rotating shaft 32, and a flange 38 is inserted, from outside of the cutter assembly 36, around the rotating shaft 32. In this state, a bolt 40 is fastened to an end portion of the rotating shaft 32, to thereby fix the cutter assembly 36 between the flanges 34 and 38.

As shown in FIG. 2, two pairs of cutter guides 42*a* and 44*a* are disposed on both sides of a disk cutter which will be described later. The cutter guides 42*a* and 44*a* are supported by a cutter guide supporting mechanism 46. As shown in FIG. 1, a pulley 52 is fixed to an output shaft 50 of a motor 48, and a pulley 54 is fixed to the rotating shaft 32. A connecting belt 56 is wound around the pulleys 52 and 54. When the motor 48 is driven, the rotating shaft 32 is rotated via the output shaft 50, pulley 52, belt 56, and pulley 54.

Figure 3:
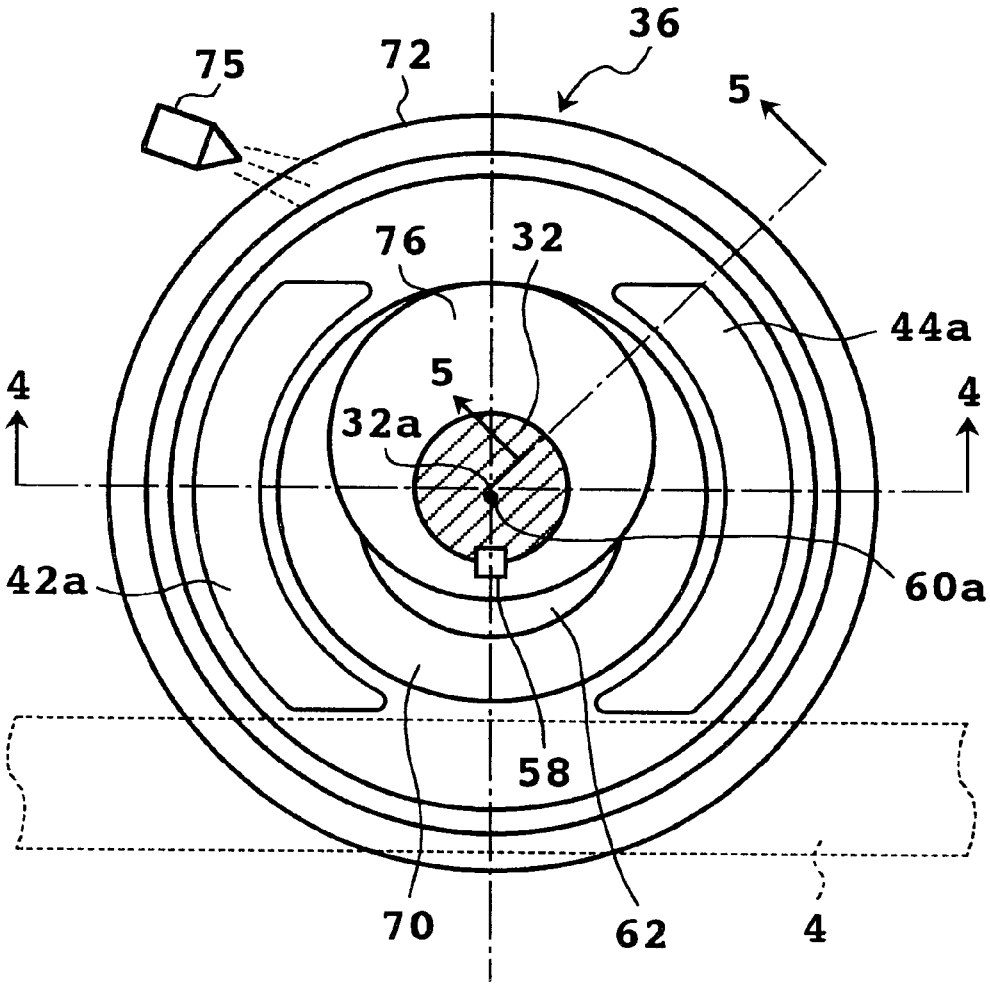
FIG. 3 is a front view of an embodiment of a cutter assembly.
Figure 4:
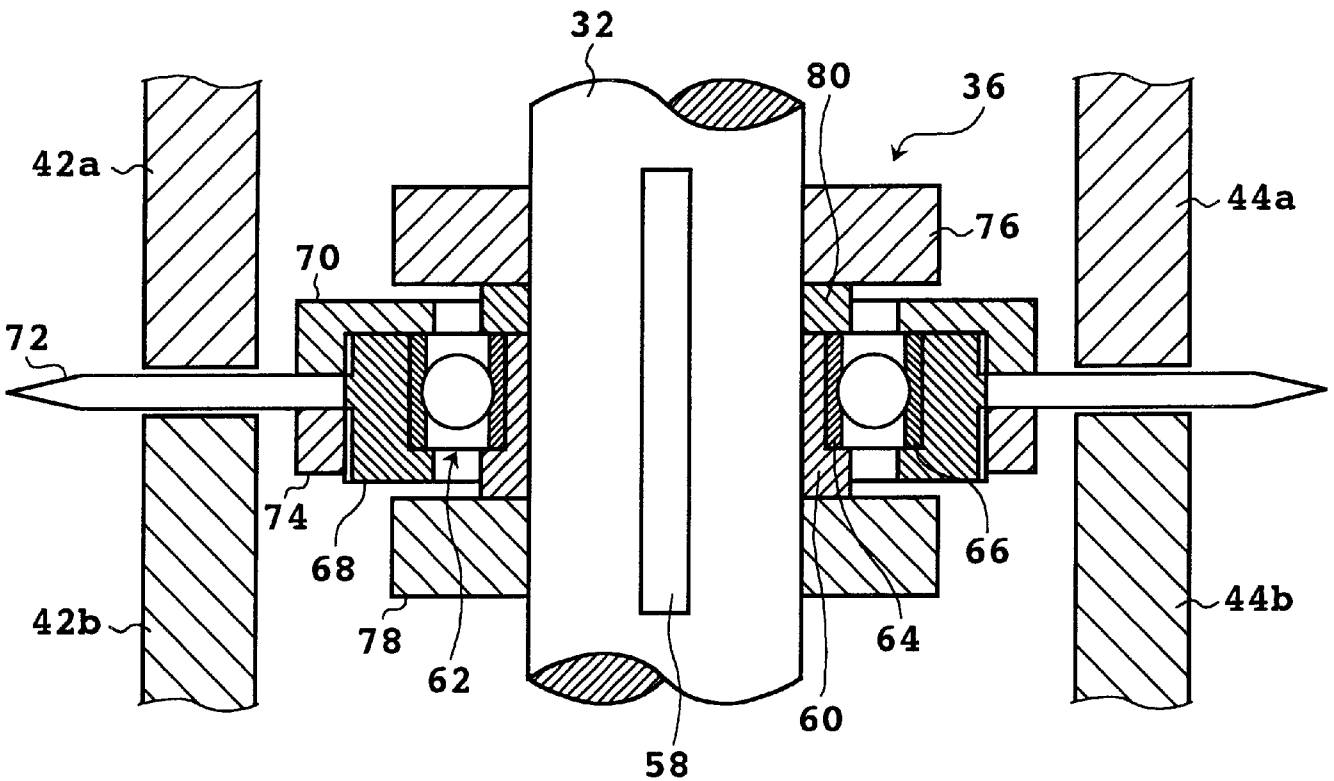
FIG. 4 is a sectional view taken on line 4—4 of FIG. 3.

A detailed structure of the cutter assembly 36 will be described with reference to FIGS. 3 and 4. As is best shown in FIG. 4, a first annular member 60, a pair of balancers 76,and 78, and a spacer 80 are fixed on the rotating shaft 32 by means of a key 58 so as not to be rotatable relative to the rotational shaft 32. As shown in FIG. 3, the first annular member 60 is mounted to the rotating shaft 32 in such a manner that a center 60*a* of the first annular member 60 is eccentric downwardly from an axis 32*a* of the rotating shaft 32 by about 1 mm. The eccentric distance of the first annular member 60 is not limited to 1 mm but is preferably in a range of about 0.3 mm to 2.0 mm.

The first annular member 60 is press-fitted in an inner race 64 of a ball bearing 62. An annular member 68 having threads on its outer peripheral surface is press-fitted around an outer race 66 of the ball bearing 62. An annular member 70 having threads on its inner peripheral surface is screwed around the annular member 68, a disk cutter 72 is inserted around the annular member 68, and an annular member 74 having threads on its inner peripheral surface is screwed around the annular member 68, whereby the disk cutter 72 is fixed relative to the outer race 66 of the ball bearing 62. In this specification, a set of the annular members 68, 70 and 74, which are integrally screwed with each other, are sometimes referred to as a second annular member.

The disk cutter 72 is made from cemented carbide, high-speed steel, alloy tool steel, or the like. The disk cutter 72 is, as shown in the figure, made thin. When the rotating shaft 32 is rotated at a high speed, the ball bearing 62 is liable to be displaced in the axial direction, and further, the workpiece 4 is pushed to the disk cutter 72 by the supply mechanism 2 at the time of cutting the workpiece 4. Accordingly, the thin disk cutter 72 is liable to be deflected. To guide such a disk cutter 72 liable to be deflected, the two pairs of cutter guides 42*a*, 42*b*, 44*a*, and 44*b* are provided.

Figure 5:
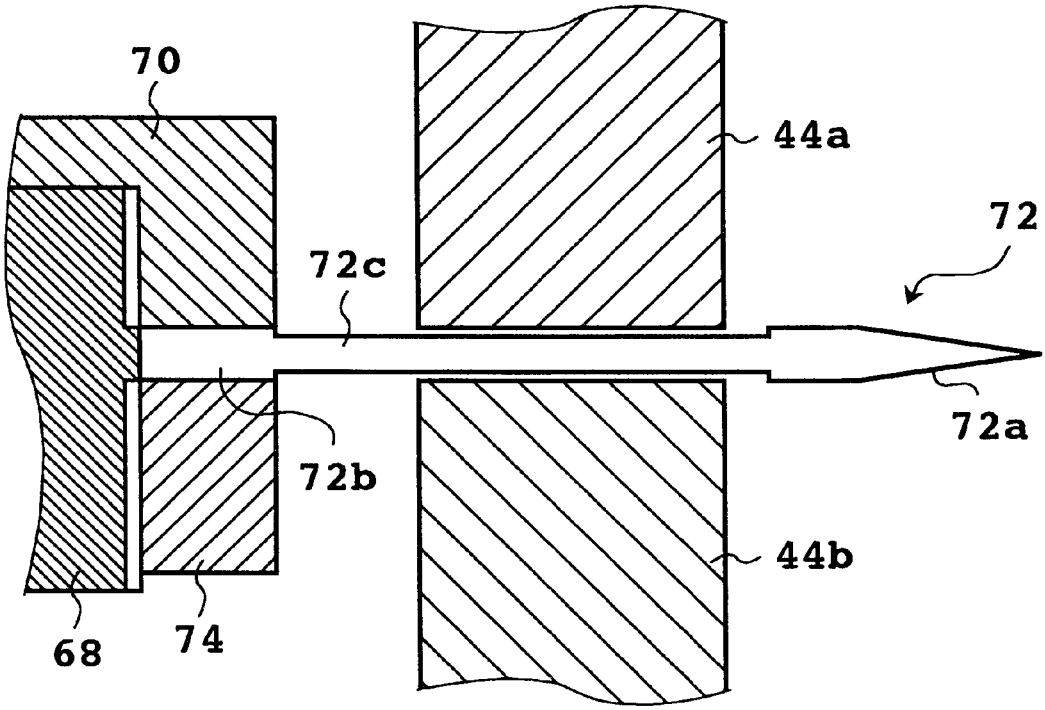
FIG. 5 is a sectional view taken on line 5—5 of FIG. 3.

As shown in an enlarged sectional view of FIG. 5, the disk cutter 72 has a tapered cutting edge 72*a*, a base end portion 72*b*, and an intermediate portion 72*c* connecting the cutting edge 72*a* to the base end portion 72*b*. To prevent the disk cutter 72 from interfering with the workpiece after cutting of the workpiece, the intermediate portion 72*c* of the disk cutter 72 is made thinner than each of a thick portion of the cutting edge 72*a* and the base end portion 72*b*. A clearance between the intermediate portion 72*c* and each of the cutter guides 44*a* and 44*b* is in a range of about 0.01 mm to about 0.05 mm.

As shown in FIG. 3, reference numeral 75 designates a cutting oil supply mechanism for supplying cutting oil to the cutting edge 72*a* of the disk cutter 72. The cutting oil supply mechanism 75 intermittently supplies a mist of cutting oil to the cutting edge 72*a* of the disk cutter 72. Alternatively, a cloth impregnated with cutting oil may be brought into direct contact with the cutting edge 72*a*. In the above-described embodiment, the disk cutter 72 is fixed to the second annular member composed of the annular members 68, 70 and 74; however, the second annular member may be omitted and the disk cutter 72 may be directly fixed to the outer race 66 of the ball bearing 62.

The operation of cutting the workpiece 4 by the cutting apparatus configured as described above will be described below. The motor 48 is driven, to rotate the rotating shaft 32 at a speed ranging from about 3,000 rpm to about 15,000 rpm. Since the disk cutter 72 is mounted to the rotating shaft 32 via the ball bearing 62, the disk cutter 72 is freely rotatable relative to the rotating shaft 32; however, because of the resistance of the ball bearing 62, the disk cutter 72 is rotated while being vibrated at a high speed in the same direction as the rotational direction of the rotating shaft 32. It is to be noted that the rotational direction of the rotating shaft 32 is not limited to the carrying direction of the workpiece 4. Namely, according to the present invention, the rotating shaft 32 may be rotated either in the same direction as the carrying direction of the workpiece 4 or in the direction opposite thereto.

The workpiece 4 is supplied to the cutting mechanism 6 by the supply mechanism 2. When the workpiece 4 thus supplied is brought into contact with the disk cutter 72, the rotation of the disk cutter 72 is stopped; however, since the disk cutter 72 is mounted to the rotational shaft 32 in the state being eccentric from the rotating shaft 32, the disk cutter 72 is vibrated at a high speed at an amplitude being twice the eccentric amount. Further, since the pair of the balancers 76 and 78 are fixed to the rotating shaft 32 while being eccentric in the direction opposite to the eccentric direction of the first annular member 60 so as to cancel the eccentric moment of the disk cutter 72, the disk cutter 72 is smoothly rotated and vibrated.

When the workpiece 4 is pushed against the disk cutter 72 by the supply mechanism 2, the cutting of the workpiece 4 by high-speed vibration of the disk cutter 72 starts, and consequently, the disk cutter 72 is slowly rotated in the same direction as the carrying direction of the workpiece 4 by a workpiece carrying force given by the supply mechanism 2. In this embodiment, the workpiece 4 is supplied at a speed of about 20 m/min. At this time, the disk cutter 72 is rotated at a speed of about 10 to 20 rpm in the same direction as the carrying direction of the workpiece 4. After being cut, the workpiece 4 is discharged from the cutting mechanism 6 by the discharge mechanism 8.

The cutting apparatus according to this embodiment configured to cut a workpiece by vibration of the disk cutter is advantageous in eliminating the inconvenience of the conventional apparatus for cutting the workpiece with a saw, that is, eliminating a loss of the workpiece due to the thickness of a saw blade and the occurrence of cut chips, thereby improving the utilization efficiency of the workpiece by reducing a loss of the workpiece and reducing the cutting cost of the workpiece.

Another embodiment of the cutter assembly will be described with reference to FIGS. 6 to 8. As shown in FIG. 7, a first annular member 84, a pair of balancers 100 and 102, and a spacer 104 are fixed to a rotating shaft 32 by means of a key 82 so as not to be rotatable relative to the rotating shaft 32. Like the first annular member 60 in the first embodiment, the first annular member 84 is fixed to the rotating shaft 32 in such a manner that a center 84*a* of the first annular member 84 is eccentric downwardly from an axis 32*a* of the rotating shaft 32 by a specific distance (for example, 1 mm).

The first annular member 84 is press-fitted in an inner race 88 of a combined angular ball bearing 86. An annular member 92 having threads on its outer peripheral surface is press-fitted around an outer race 90 of the ball bearing 86. An annular member 94 having threads on its inner peripheral surface is screwed around the annular member 92, a disk cutter 96 is inserted around the annular member 92, and an annular member 98 having threads on its inner peripheral surface is fastened around the annular member 92, whereby the disk cutter 96 is fixed relative to the outer race 90 of the ball bearing 86.

Like the cutter assembly 36 in the first embodiment, a set of the annular members 92, 94, and 98 integrally fixed to each other is referred to as "second annular member" in this specification. A pair of balancers 100 and 102 are fixed to the rotating shaft 32 so as to cancel the eccentric moment of the disk cutter 96. The annular member 94 has in its outer periphery a plurality of cutouts 95, and locking claws 106 are mounted so as to be selectively engageable with the cutouts 95. The cutouts 95 and the locking claws 106 constitute a one-way rotating mechanism. In this embodiment, the one-way rotating mechanism is configured to permit the rotation of the disk cutter 96 in the counter-clockwise direction and prohibit the rotation of the disk cutter 96 in the clockwise direction.

Accordingly, in the cutter assembly in this embodiment, which is designated by reference numeral 36', when the rotating shaft 32 is rotated clockwise, the rotation of the disk cutter 96 at the time of idling is prevented by the one-way rotating mechanism composed of the cutouts 95 and the locking claws 106. Since the rotation of the disk cutter 96 at the time of idling of the cutter assembly 36' to which any workpiece is not supplied is prevented as described above, it is possible to ensure the safety of an operator.

Figure 6:
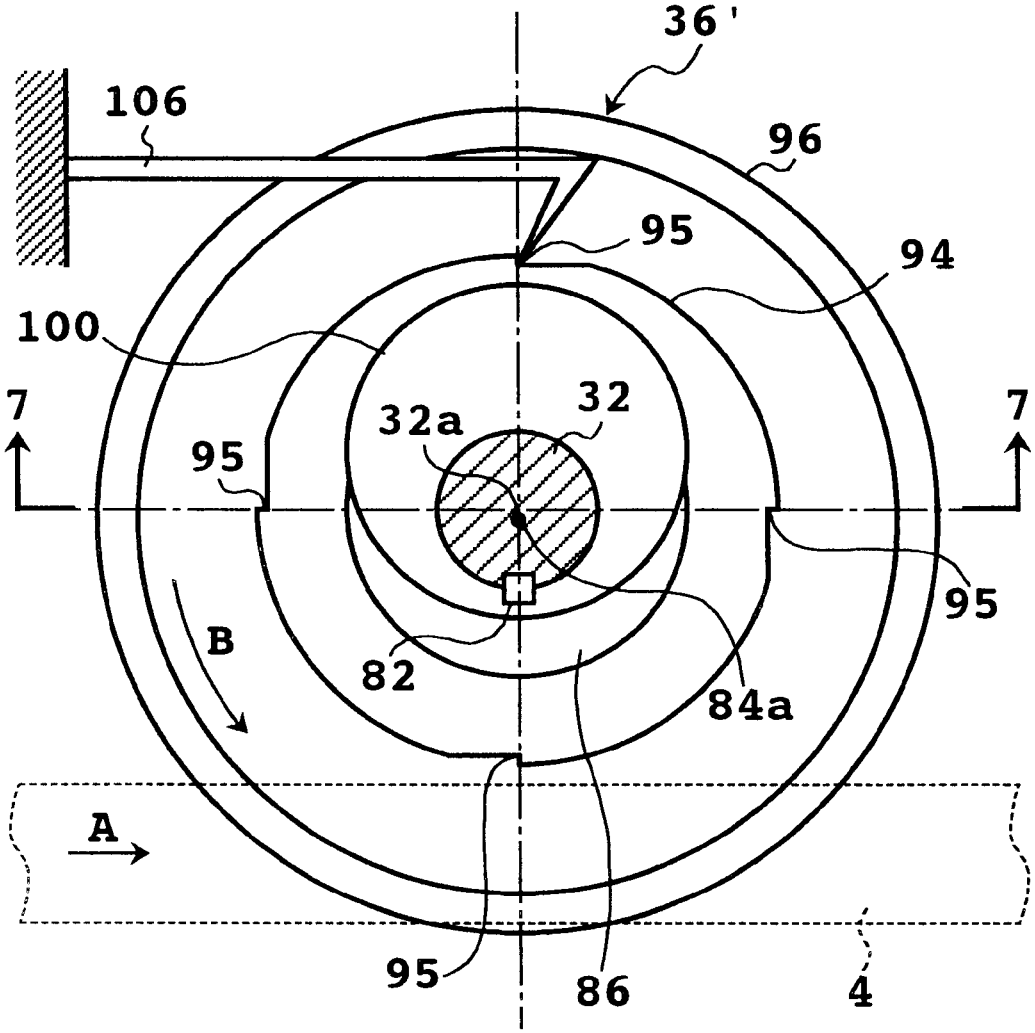
FIG. 6 is a front view of another embodiment of the cutter assembly.
Figure 7:
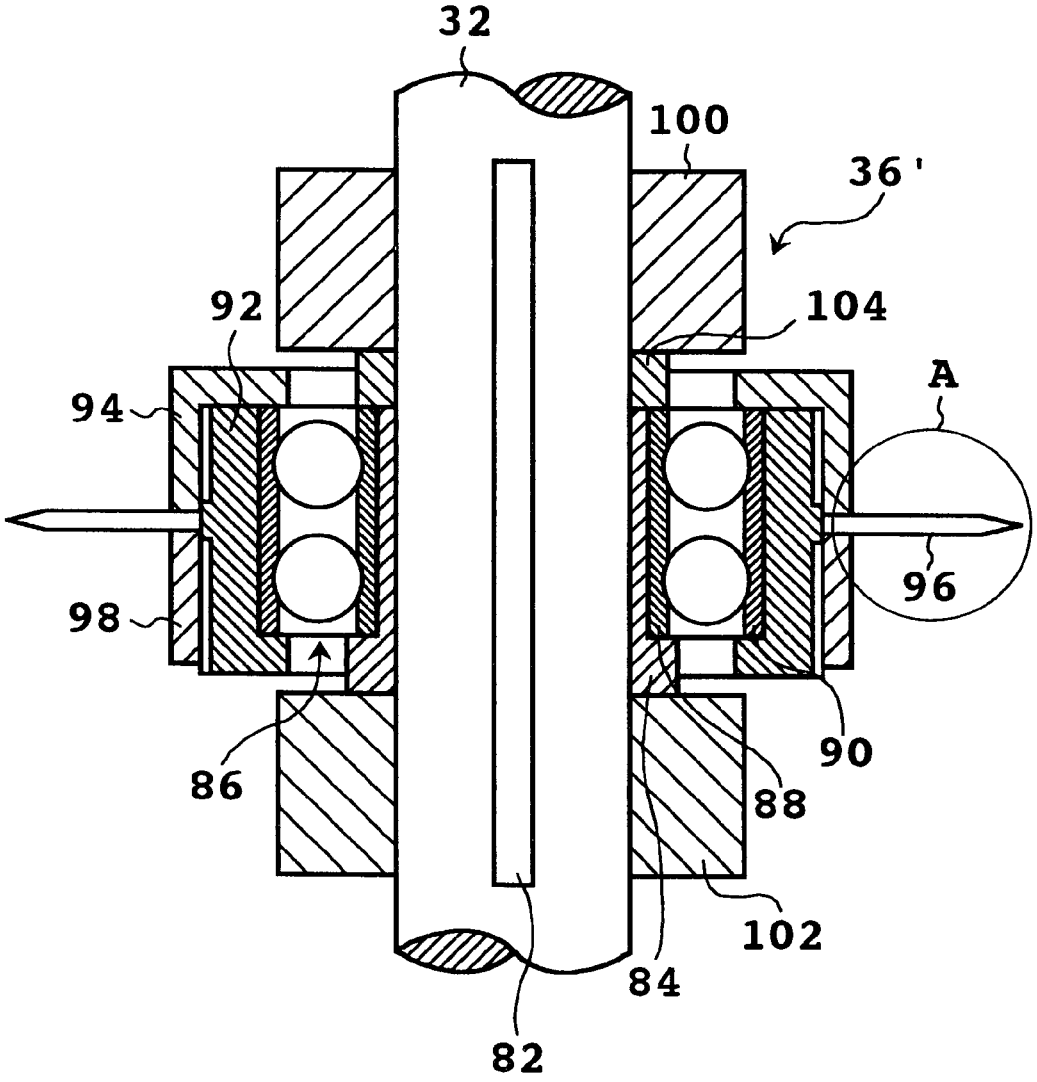
FIG. 7 is a sectional view taken on line 7—7 of FIG. 6.

When a workpiece 4 is supplied in the direction shown by arrow A in FIG. 6 and is cut by vibration of the disk cutter 96, the disk cutter 96 is slowly rotated at about 10 to 20 rpm in the direction shown by arrow B, that is, counterclockwise by a workpiece supply force.

Figure 8:
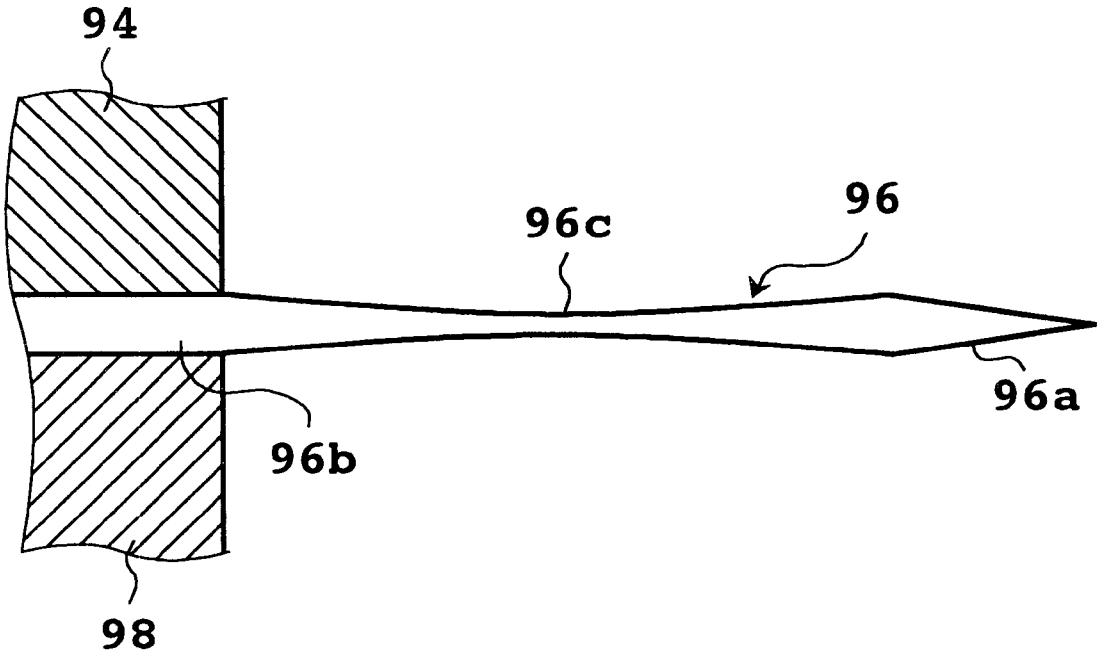
FIG. 8 is a partial enlarged view of a portion A shown in FIG. 7.

FIG. 8 is an enlarged sectional view of a portion surrounded by a circle A shown in FIG. 7. The disk cutter 96 has a tapered cutting edge 96*a,* a base end portion 96*b,* and a thin intermediate portion 96*c* which connects the cutting edge 96*a* to the base end portion 96*b*. Since the intermediate portion 96*c* is made thin, it is possible to prevent interference between a workpiece and the disk cutter 96 after the workpiece is cut. In the cutter assembly 36' of this embodiment, since the combined angular ball bearing 86 is used, the outer race 90 of the ball bearing 86 is not displaced in the axial direction at the time of high-speed rotation of the rotating shaft 32.

According to this embodiment, the cutter guides 42*a,* 42*b,* 44*a,* and 44*b* used for the cutter assembly 36 in the first embodiment can be omitted. However, since the combined angular ball bearing 86 is heavier than the single row bearing 62 used in the first embodiment, there is a disadvantage that the overall weight of the cutter assembly 36' becomes heavier.

Figure 9:
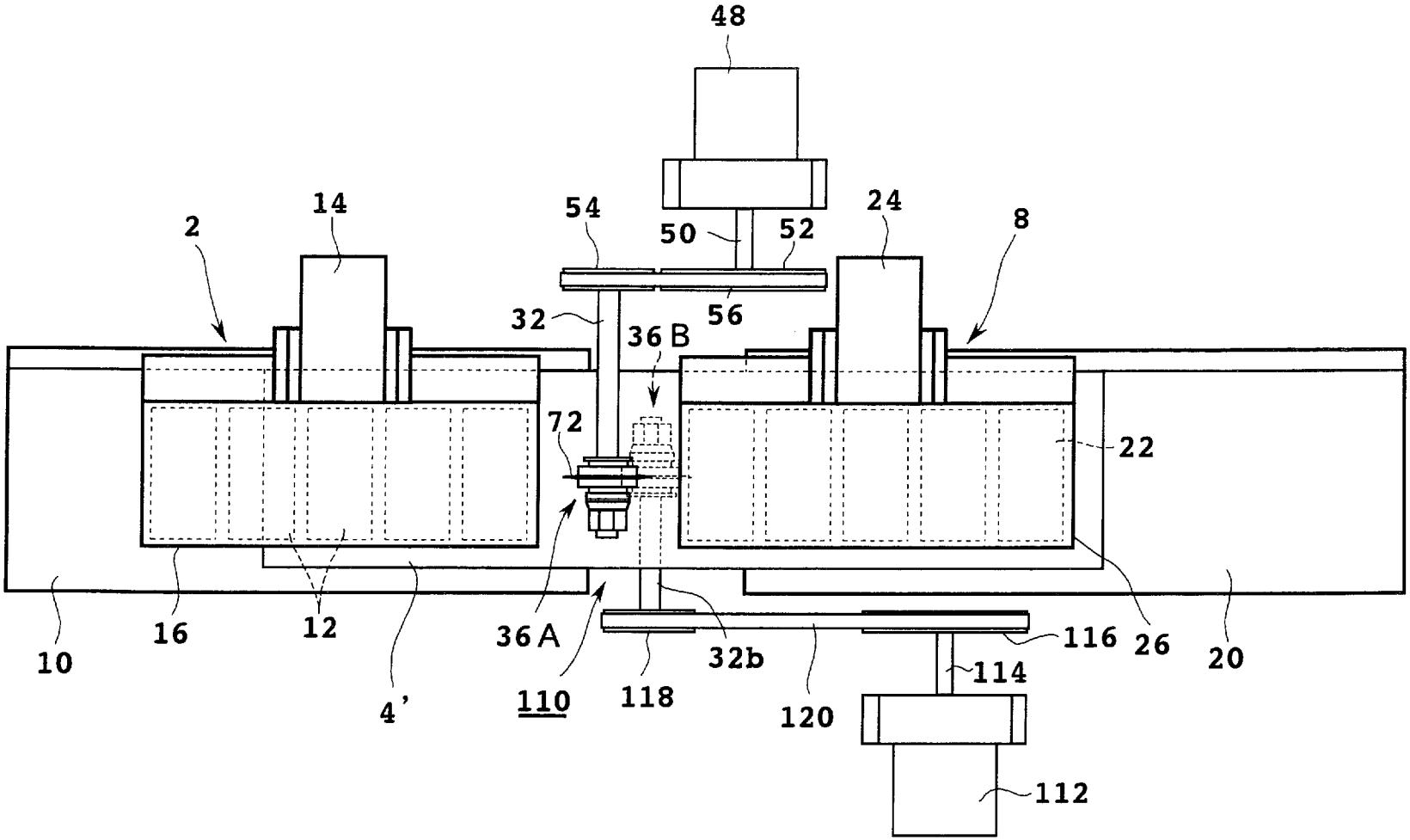
FIG. 9 is a plan view of a cutting apparatus according to a second embodiment of the present invention.
Figure 10:
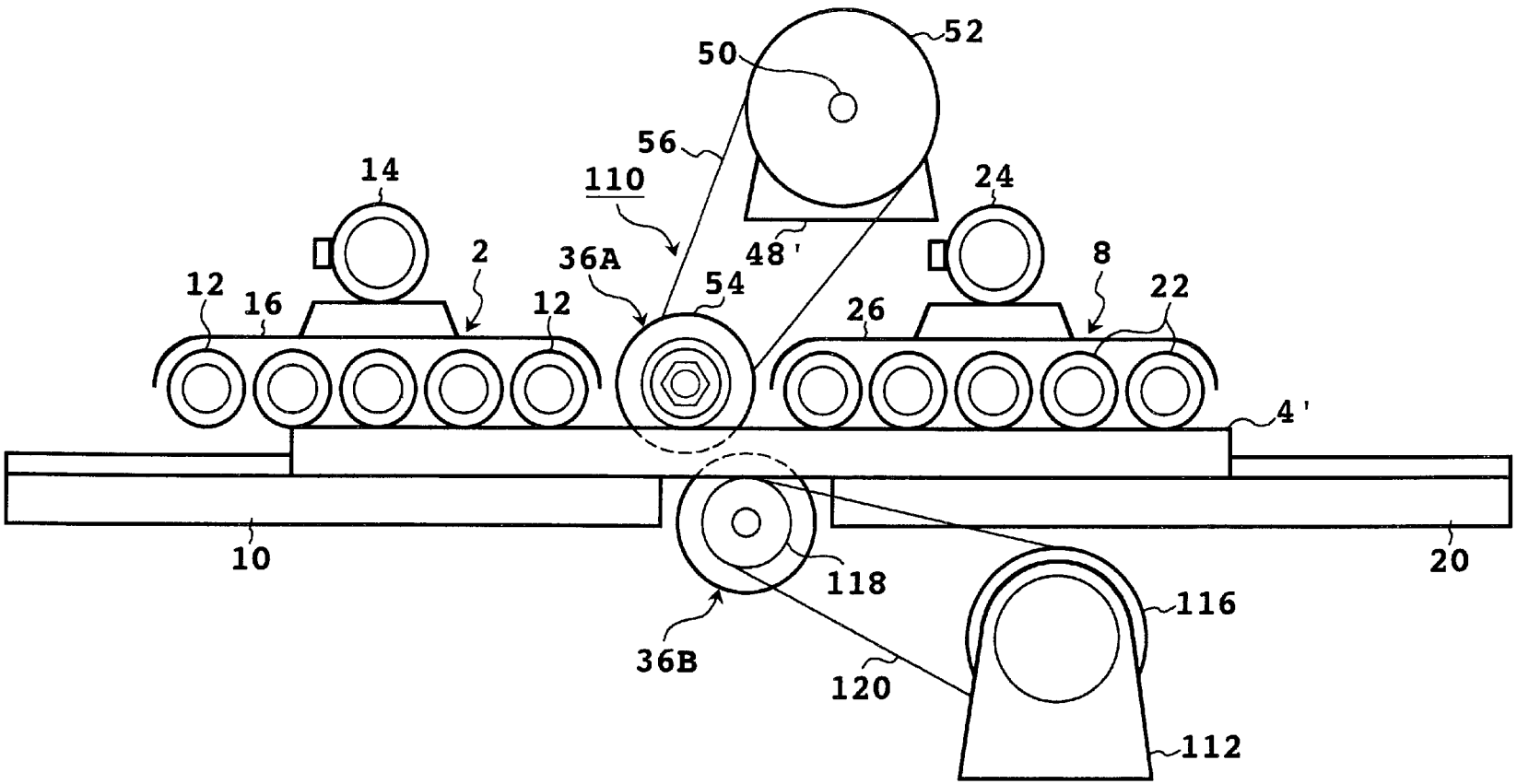
FIG. 10 is a front view of the cutting apparatus according to the second embodiment.

Referring to FIG. 9, there is shown a plan view of a cutting apparatus according to a second embodiment of the present invention. FIG. 10 is a front view of the cutting apparatus shown in FIG. 9. A cutting mechanism 110 in this embodiment includes a first cutter assembly 36A provided on the upper side of a workpiece 4', and a second cutter assembly 36B provided on the lower side of the workpiece 4'. The first cutter assembly 36A disposed on the upper side of the workpiece 4' cuts the upper half of the workpiece 4' and the second cutter assembly 36B disposed on the lower side of the workpiece 4' cuts the lower half of the workpiece 4'. In this embodiment, since the first and second cutter assemblies 36A and 36B are disposed on the upper and lower sides of the workpiece 4' to be cut, the workpiece 4' can be easily cut even if it is relatively thick.

The second cutter assembly 36B is driven by a motor 112. A pulley 116 is fixed to an output shaft 114 of the motor 112, and a pulley 118 is fixed to a rotating shaft 32b of the second cutter assembly 36B. A connecting belt 120 is wound around the pulleys 116 and 118. A rotational force of the motor 112 is thus transmitted to the rotating shaft 32b via the output shaft 114, pulley 116, belt 120, and pulley 118. Each of the first and second cutter assemblies 36A and 36B has the same configuration as that of the cutter assembly 36 shown in FIGS. 3 and 4. It is to be noted that cutter guides are not shown in the figures. Alternatively, each of the first and second cutter assemblies 36A and 36B may have the same configuration as that of the cutter assembly 36' shown in FIGS. 6 and 7.

Figure 11:
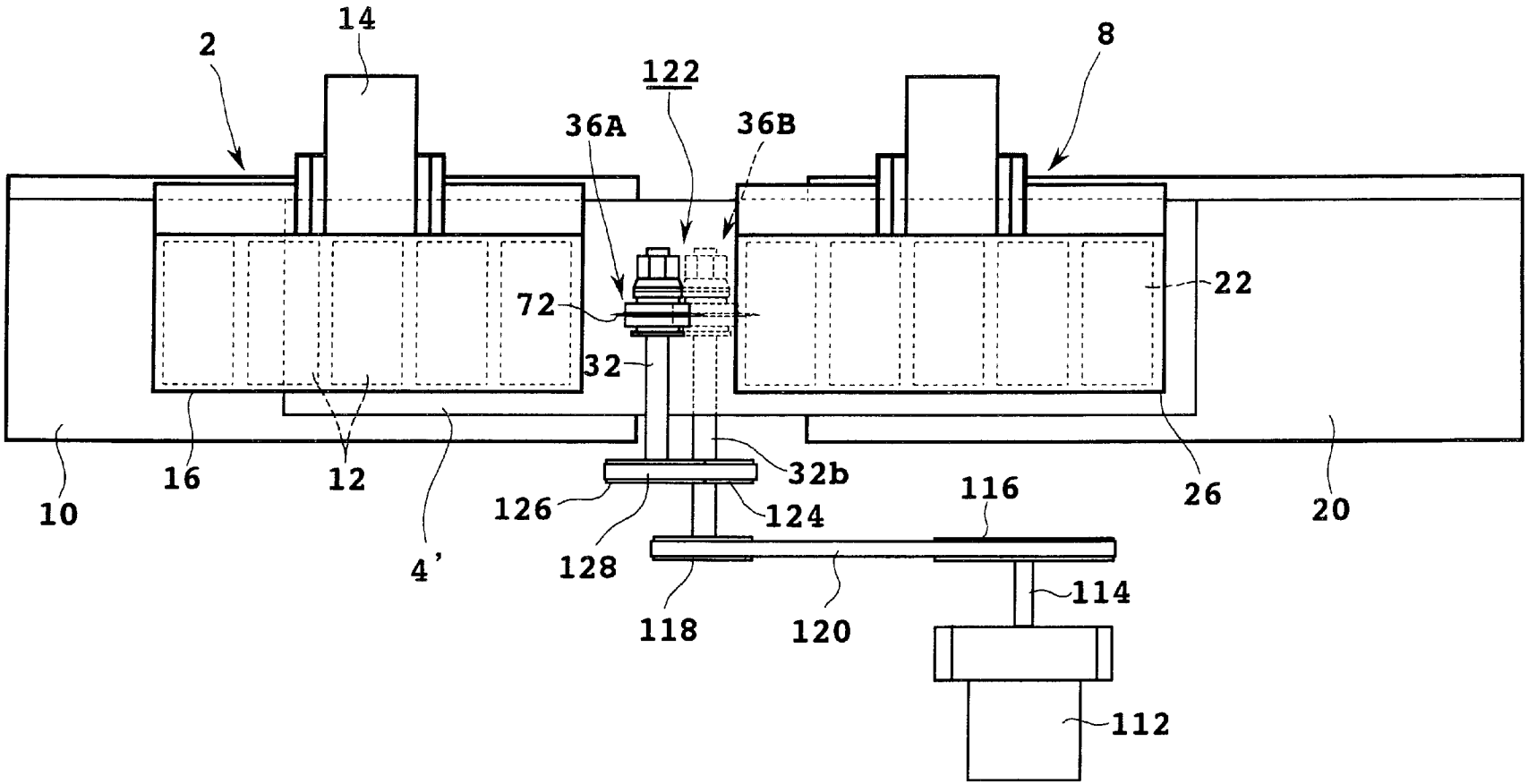
FIG. 11 is a plan view of a cutting apparatus according to a third embodiment of the present invention.
Figure 12:
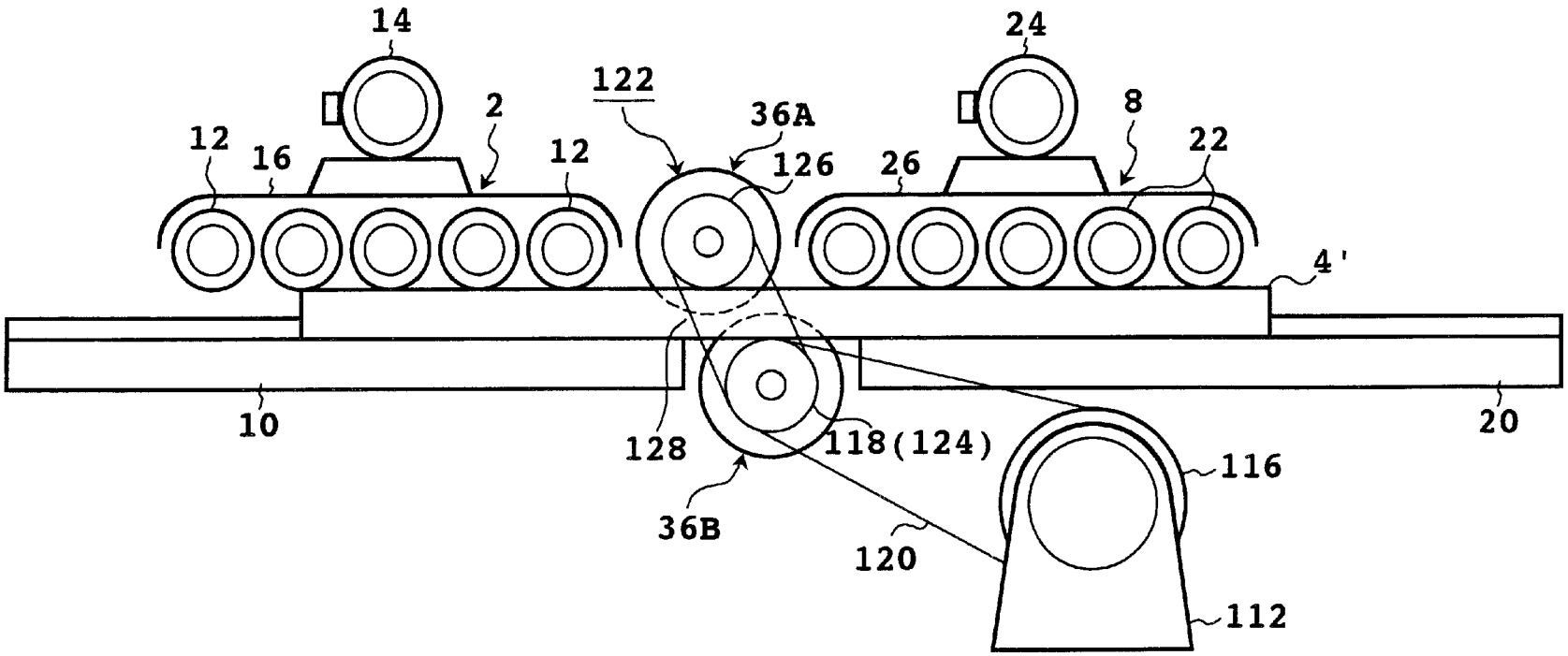
FIG. 12 is a front view of the cutting apparatus according to the third embodiment.

Referring to FIG. 11, there is shown a plan view of a cutting apparatus according to a third embodiment of the present invention. FIG. 12 is a plan view of the cutting apparatus shown in FIG. 11. A first cutter assembly 36A and a second cutter assembly 36B of a cutting mechanism 122 in this embodiment are arranged in the same manner as that in the cutting mechanism 110 in the second embodiment. This embodiment, however, is different from the second embodiment in that the first and second cutter assemblies 36A and 36B are driven by one motor 112. To be more specific, a timing belt-pulley 124 is fixed to a rotating shaft 32*b* of the second cutter assembly 36B, and a timing belt-pulley 126 having the same diameter as that of the timing belt-pulley 124 is fixed to a rotating shaft 32 of the first cutter assembly 36A. A timing belt 128 is wound around the timing belt-pulley 124 and the timing belt-pulley 126.

A rotational force of the motor 112 is transmitted to the rotating shaft 32*b* of the second cutter assembly 36B via an output shaft 114, pulley 116, a belt 120, and pulley 118. The rotational force of the rotating shaft 32*b* is then transmitted to the rotating shaft 32 of the first cutter assembly 36A via the timing belt-pulley 124, timing belt 128, and the timing belt-pulley 126.

Since the timing belt-pulleys 124 and 126 have the same diameter as described above, the rotating shafts 32 and 32*b* of the first and second cutter assemblies 36A and 36B are rotated in synchronization with each other. The eccentric direction of a center of a first annular member 60 of the first cutter assembly 36A from an axis of the rotating shaft 32 is preferably opposite to the eccentric direction of a center of a first annular member 60 of the second cutter assembly 36B from an axis of the rotating shaft 32*b*. Since the first and second cutter assemblies 36A and 36B are mounted to the rotating shafts 32 and 32*b* with phases thereof offset from each other by 180 degrees as described above, the disk cutters 72 of the first and second cutter assemblies 36A and 36B receive phase vibrations in the opposite direction, to thereby reduce vibration and noise of the overall apparatus.

Alternatively, the eccentric direction of the center of the first annular member 60 of the first cutter assembly 36A from the axis of the rotating shaft 32 may be set to be the same as the eccentric direction of the center of the first annular member 60 of the second cutter assembly 36B from the axis of the rotating shaft 32*b*. Even in this case, since the vibrational phases of the first and second cutter assemblies 36A and 36B are synchronized with each other, noise of the overall apparatus can be reduced. Further, loads applied to the motor and a power drive portion can be equalized, to reduce the vibration of the apparatus and improve the durability thereof.

The cutter assembly 36 shown in FIGS. 3 and 4 or the cutter assembly 36' shown in FIGS. 6 and 7 may be applied for each of the first and second cutter assemblies 36A and 36B in this embodiment. In the above-described cutter assemblies 36 and 36', the ball bearings 62 and 86 are used; however, the bearing used in each of the cutter assemblies 36 and 36' is not limited to the ball bearing but may be configured as an air bearing, an oil bearing, or the like.

It is to be noted that the balancers 76, 78, 100, and 102 are not necessarily provided. In this case, in the cutter assembly 36 shown in FIGS. 3 and 4, the first annular member 60 may be balanced in weight such that a center of gravity of a rotator composed of the first annular member 60, bearing 62, second annular member, and disk cutter 72 coincide to the axis of the rotating shaft 32. For example, the first annular member 60 may be balanced in weight by perforating the first annular member 60 with a drill or the like. The same is true for the cutter assembly 36' shown in FIGS. 6 and 7.

The cutting apparatus of the present invention is configured to cut a workpiece while driving the wedge-shaped cutting edge in the workpiece by making use of a vibrational motion of a disk cutter. Accordingly, materials of workpieces to be cut by the cutting apparatus of the present invention are not limited to wood materials but may be other materials such as resin, rubber, paper, various fibers, and meat materials.

As described above in detail, according to the present invention, since a workpiece is cut by vibrating a disk cutter at a high speed, it is possible to eliminate the inconvenience of the prior art apparatus for cutting a workpiece with a saw, that is, eliminate a loss of the workpiece due to the thickness of a saw blade and the occurrence of cut chips. Accordingly, the cutting apparatus of the present invention, which can improve the utilization efficiency of a workpiece by reducing a loss of the workpiece and eliminate the occurrence of cut chips, can reduce the cutting cost of the workpiece by eliminating time and effort spent for discarding a large amount of cut chips and a running cost. Further, as compared with the prior art apparatus for cutting a workpiece with a saw, it is possible to reduce the noise level, and to smoothen the cut surface of a workpiece and hence to reduce time and effort spent for finishing the cut surface.

The present invention is not limited to the details of the above-described preferred embodiments. The scope of the invention is defined by the appended claims and all changes and modifications as fall within the equivalence of the scope of the claims are therefore to be embraced by the invention.

What is claimed is:

1. A cutting apparatus comprising:

a first annular member having a center eccentric from an axis of a rotating shaft and fixed to said rotating shaft;

a bearing having an inner race and an outer race, said inner race being fixed to said first annular member;

a disk cutter fixed relative to said outer race of said bearing; and a balancer fixed to said rotating shaft in a state being eccentric in the direction opposite to the eccentric direction of said first annular member.

2. A cutting apparatus according to claim 1, further comprising:

a second annular member fixed to said outer race of said bearing;

wherein said disk cutter is fixed to said second annular member.

3. A cutting apparatus according to claim 1, further comprising at least a pair of cutter guides disposed on both sides of said disk cutter.

4. A cutting apparatus according to claim 2, further comprising:

a workpiece carrying mechanism for carrying a workpiece; and a one-way rotating mechanism selectively engageable with either one of said disk cutter and said second annular member;

wherein said rotating shaft is rotated in the direction opposite to the carrying direction of said workpiece; and said one-way rotating mechanism prohibits the rotation of said disk cutter at the time of idling and permits the rotation of said disk cutter in the same direction as the workpiece carrying direction by a workpiece carrying force at the time of cutting.

5. A cutting apparatus according to claim 1, further comprising a cutting oil supply mechanism for supplying cutting oil to a cutting edge of said disk cutter.

6. A cutting apparatus according to claim 1, wherein a distance between the center of said first annular member and the axis of said rotating shaft is in a range of 0.3 mm to 2.0 mm.

7. A cutting apparatus comprising:

an annular member having a center eccentric from an axis of a rotating shaft and fixed to said rotating shaft;

a bearing fixed to said annular member; and a disk cutter fixed relative to said bearing;

wherein said annular member is balanced in weight such that a center of gravity of a rotator including said annular member, said bearing, and said disk cutter coincides with the axis of said rotating shaft.

8. A cutting apparatus comprising:

a workpiece carrying mechanism for carrying a workpiece;

a first cutter assembly for partially cutting a workpiece carried by said workpiece carrying mechanism, said first cutter assembly being disposed on the upper side of said workpiece; and a second cutter assembly for partially cutting a workpiece carried by said workpiece carrying mechanism, said second cutter assembly being disposed on the lower side of said workpiece;

wherein each of said first and second cutter assemblies comprises:

a first annular member having a center eccentric from an axis of a rotating shaft and fixed to said rotating shaft;

a bearing having an inner race and an outer race, said inner race being fixed to said first annular member;

a disk cutter fixed relative to said outer race of said bearing; and a balancer fixed to said rotating shaft in a state being eccentric in the direction opposite to the eccentric direction of said first annular member.

9. A cutting apparatus according to claim 8, further comprising:

a synchronizing mechanism for rotating said rotating shaft of said first cutter assembly and said rotating shaft of said second cutter assembly in synchronization with each other, wherein the eccentric direction of the center of said first annular member of said first cutter assembly from the axis of said rotating shaft of said first cutter assembly is opposite to the eccentric direction of the center of said first annular member of said second cutter assembly from the axis of said rotating shaft of said second cutter assembly.

10. A cutting apparatus according to claim 8, further comprising:

a synchronizing mechanism for rotating said rotating shaft of said first cutter assembly and said rotating shaft of said second cutter assembly in synchronization with each other, wherein the eccentric direction of the center of said first annular member of said first cutter assembly from the axis of said rotating shaft of said first cutter assembly is the same as the eccentric direction of the center of said first annular member of said second cutter assembly from the axis of said rotating shaft of said second cutter assembly.

* * * * *